US008499676B1

(12) United States Patent
Moore et al.

(10) Patent No.: US 8,499,676 B1
(45) Date of Patent: Aug. 6, 2013

(54) COUPLER SYSTEM FOR ATTACHING BLANK ADAPTOR AND THE LIKE TO A FLASH HIDER

(75) Inventors: Charles Moore, Columbia, SC (US); Thomas Mooty, Columbia, SC (US)

(73) Assignee: FN Manufacturing, LLC, Columbia, SC (US)

( * ) Notice: Subject to any disclaimer, the term of this patent is extended or adjusted under 35 U.S.C. 154(b) by 190 days.

(21) Appl. No.: 13/211,811

(22) Filed: Aug. 17, 2011

Related U.S. Application Data

(60) Provisional application No. 61/375,620, filed on Aug. 20, 2010, provisional application No. 61/375,339, filed on Aug. 20, 2010, provisional application No. 61/375,570, filed on Aug. 20, 2010.

(51) Int. Cl.
*F41A 21/32* (2006.01)

(52) U.S. Cl.
USPC ..... 89/14.2; 89/14.4; 42/90

(58) Field of Classification Search
USPC ..... 89/14.2–14.4; 181/223; 42/90
See application file for complete search history.

(56) References Cited

U.S. PATENT DOCUMENTS

| | | | | |
|---|---|---|---|---|
| 2,870,679 | A | 1/1959 | Collins | |
| 4,588,043 | A * | 5/1986 | Finn | 181/223 |
| 4,664,014 | A | 5/1987 | Hawley et al. | |
| 5,479,736 | A * | 1/1996 | Forrester | 42/72 |
| 5,596,161 | A | 1/1997 | Sommers | |
| 5,883,328 | A | 3/1999 | A'Costa | |
| 6,308,609 | B1 | 10/2001 | Davies | |
| 6,374,718 | B1 * | 4/2002 | Rescigno et al. | 89/14.4 |
| 6,575,074 | B1 * | 6/2003 | Gaddini | 89/14.4 |
| 6,619,179 | B2 * | 9/2003 | Mika | 89/14.05 |
| 6,973,863 | B1 * | 12/2005 | Jones | 89/14.2 |
| 7,073,426 | B1 | 7/2006 | White | |
| 7,237,467 | B1 | 7/2007 | Melton | |
| 7,302,774 | B2 | 12/2007 | Meyers | |
| 7,308,967 | B1 | 12/2007 | Hoel | |
| 7,412,917 | B2 | 8/2008 | Vais | |
| 7,735,406 | B1 * | 6/2010 | Olson | 89/14.3 |
| 1,017,003 | A1 | 2/2012 | Kenney | |
| 8,167,084 | B1 * | 5/2012 | Moore | 181/223 |
| 8,439,155 | B2 * | 5/2013 | Shults et al. | 181/223 |
| 2012/0180623 | A1 * | 7/2012 | Graham et al. | 89/14.4 |
| 2012/0199415 | A1 * | 8/2012 | Shults et al. | 181/223 |

FOREIGN PATENT DOCUMENTS

| | | |
|---|---|---|
| FR | 981869 | 1/1951 |

* cited by examiner

*Primary Examiner* — Michael David
(74) *Attorney, Agent, or Firm* — Michael A. Mann; Nexsen Pruet, LLC

(57) ABSTRACT

A coupling system attaches a device such as a blank adaptor or a sound suppressor to the flash hider of a firearm. The device is slid over the flash hider until a set of flat surfaces on it are aligned with a set of holes in the device. Camming latches are held in the holes in the device. The collar carried by the device is then threadably advanced to a locking position with respect to the device where it presses the camming latches into secure engagement with the flat surfaces on the flash hider. Unthreading the collar to the unlocked position allows the camming latches to be moved radially when the device is to be removed or rotated. A spring lock prevents the collar from rotating during use, particularly during firing of the firearm but may be released to rotate the collar between locked and unlocked positions.

11 Claims, 9 Drawing Sheets

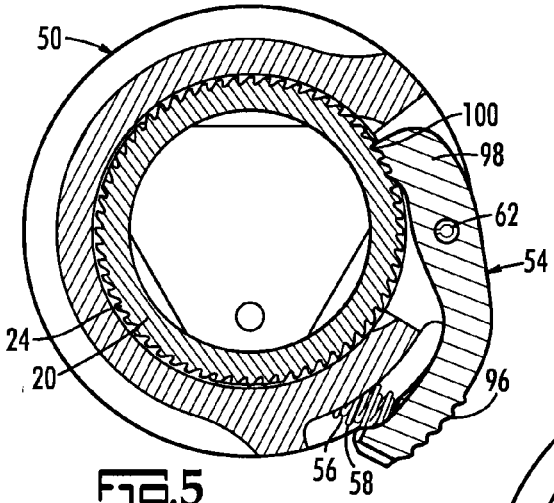
FIG.5
FIG.6
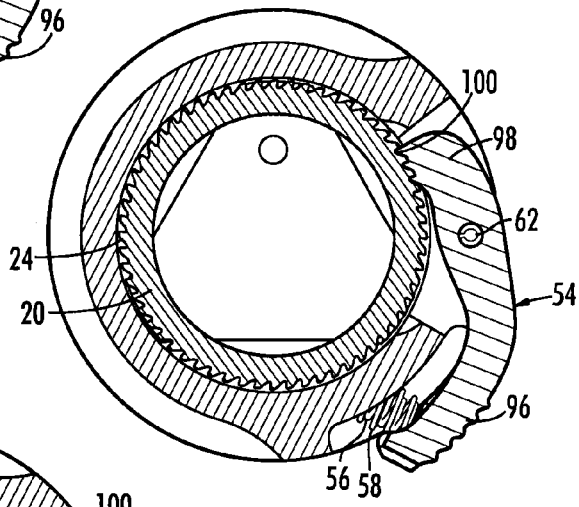
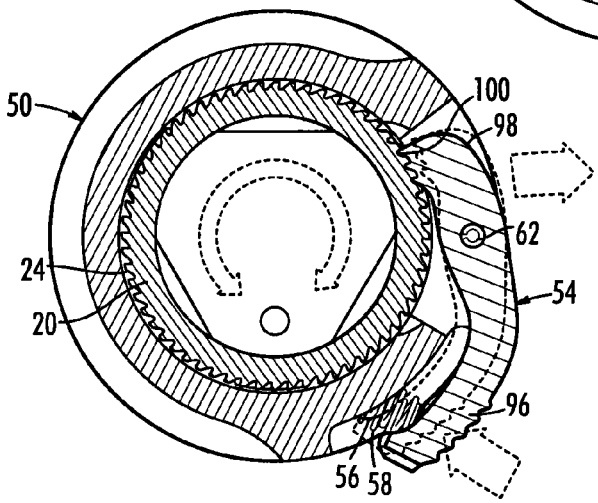
FIG.7

COUPLER SYSTEM FOR ATTACHING BLANK ADAPTOR AND THE LIKE TO A FLASH HIDER

PRIORITY CLAIM

The priority benefit of U.S. provisional patent application 61/375,620, filed Aug. 20, 2011, is claimed. This patent application is related to U.S. provisional patent application Ser. No. 61/375,339 and Ser. No. 61/375,570, both also filed Aug. 20, 2010. Applications 61/375,620, 61/375,339 and 61/375,570 are all incorporated herein in their entirety by reference.

BACKGROUND OF THE INVENTION

Blank adapters and sound suppressors are examples of devices that are sometimes attached to the muzzle of a military style firearm. The muzzle typically includes a flash hider threaded to the end of the barrel and these devices are fitted to the flash hider.

Blank adaptors are used in training to allow the firearm to fire "blank", as opposed to "live", rounds of ammunition. If the combustion gases from the firing of a blank are allowed to escape from the unrestricted muzzle of a gun, there is insufficient back pressure to chamber the next round. A blank adaptor restricts the exit of the muzzle so that there is sufficient back pressure for chambering that next round.

A sound suppressor may also be fitted to the end of a gun to absorb the sound and minimize the flash of the fired round so as to reduce the likelihood that the marksman's position will be detected.

SUMMARY OF THE INVENTION

The present invention is a coupler system for attaching devices such as blank adaptors and sound suppressors to the flash hider of a firearm. Blank adaptors and sound suppressors will be referred to herein simply as "attachable devices", or simply "devices" for convenience. Prior art devices may be modified for use in the present coupler system. Other than that modification, the balance of a prior art attachable device is in all other respects unchanged; that is, if the prior art device is a blank adaptor, those of its features that cause it to operate as a blank adaptor remain unchanged. Those features that connect it to a firearm on the other hand will be modified in accordance with the present invention to interface with the balance of the present coupler system. Similarly in the case of a sound suppressor, those portions of the suppressor that function to suppress sound remain unchanged but those features that are intended to attach it to a firearm are modified in accordance with the present invention.

The present coupler system includes an attachable device, a collar, plural camming latches, a spring lock, and a stop ring to secure the collar to a device, all of which comprise the present coupler system. The attachable device may be a blank adaptor or sound suppressor or the like.

The locking collar surrounds the proximal end of the attachable device. The collar is threaded on the inside, and the attachable device, threaded on the outside to enable the collar to advance toward or retreat from the distal end of the attachable device depending on whether the collar is rotated clockwise or counter-clockwise, respectively. The attachable device has cutouts formed through its peripheral wall at its proximal end. These cutouts are dimensioned to receive the camming latches, and to enable them to engage the flash hider inside the collar and thereby help to hold the attachable device to the flash hider. As the collar advances, its interior surface cams the camming latches, held against axial movement by the cutouts, against the exterior of the flash hider, thus locking the device to the flash hider. The spring lock prevents the collar from backing itself out of that locked position, and the stop ring limits proximal travel of the collar when the collar is moved out of the locked position.

An important feature of the present invention is the use of plural camming latches to lock the attachable device to the flash hider. This arrangement provides a secure way to lock the attachable device to the flash hider with a gas tight seal, but it also allows the attachable device to be attached in different rotational orientations. The significance of this feature is especially important when the attachable device is a sound suppressor. Each rotational orientation of a suppressor on a flash hider will have a slightly different effect on the trajectory of rounds fired by that firearm. One of those orientations will have the least effect, one that is ideally or potentially an effect small enough to make re-zeroing the firearm with the suppressor unnecessary. Once that position is known, the device can be attached in the same rotational orientation each time and the marksman will know that the firearm will perform in a manner similar to the way it does without the device.

Other features and their advantages will be apparent to those skilled in firearm attachments from a careful reading of the Detailed Description of Preferred Embodiments, accompanied by the following drawings.

BRIEF DESCRIPTION OF THE DRAWINGS

In the figures,

FIG. 5 is a cross-sectional view taken along lines 5-5 of FIG. 3;

FIG. 6 is a cross-sectional view taken along lines 6-6 of FIG. 4;

FIG. 7 is a cross-sectional view taken taken along lines 5-5 of FIG. 3 showing the operation of spring lock in enabling rotation of the attachable device;

DETAILED DESCRIPTION OF PREFERRED EMBODIMENTS

The present invention is a coupling system for attaching an attachable device such as a sound suppressor or blank adaptor to the flash hider of a firearm. The device and the flash hider are part of the present invention. However, the flash hider and device may be prior art sound suppressors and blank adapters modified to accommodate the present coupling system while their functional aspects, namely, their respective structures for suppressing sound and enabling a firearm to fire blank ammunition in the same manner as live ammunition, are otherwise the same as before.

Figure 8:
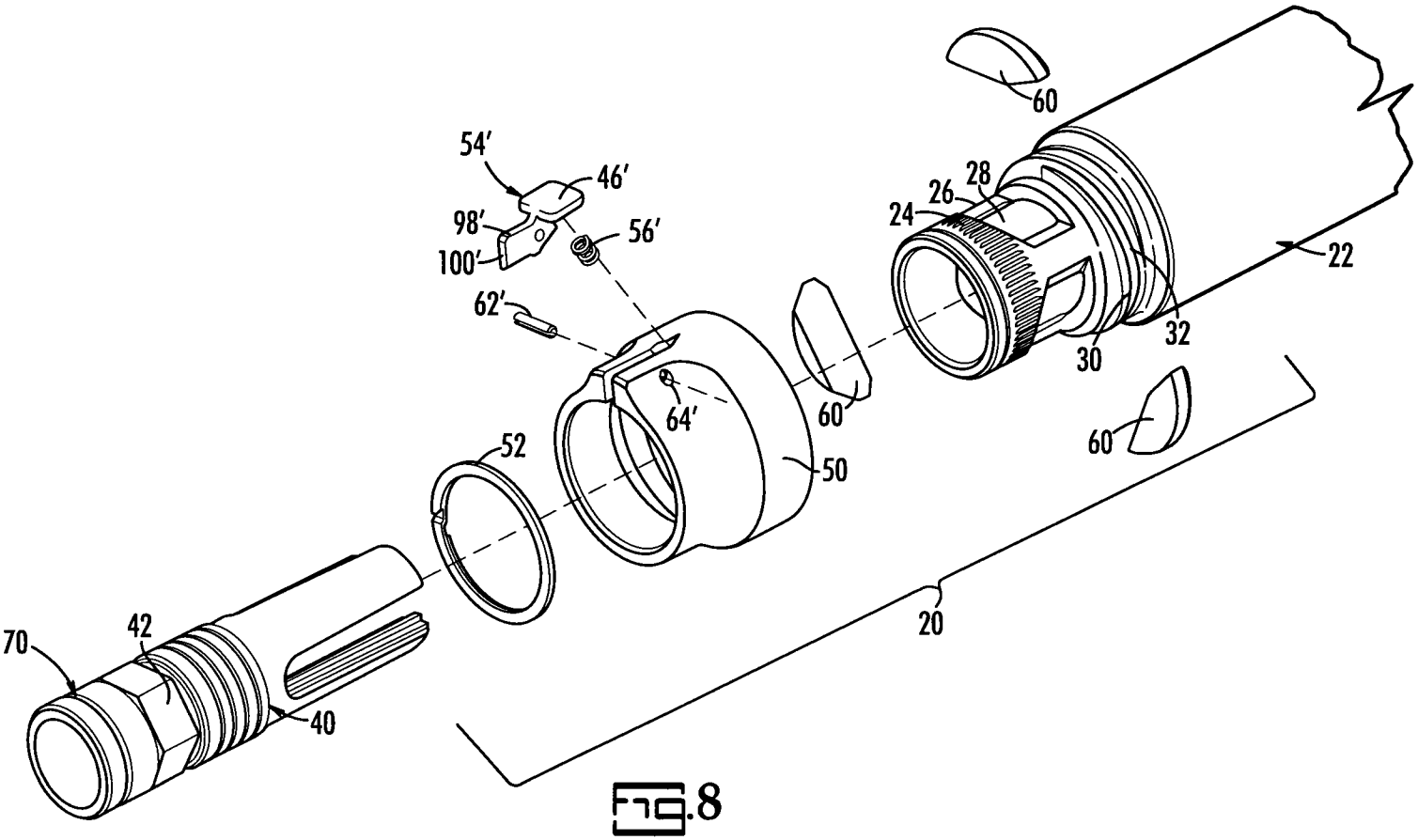
FIG. 8 is an exploded perspective view of an alternative embodiment of the present coupler system having a different spring lock.

FIGS. 1-7 illustrate a first embodiment of the present coupler system; FIG. 8 illustrates the present coupler system with an alternative spring lock; FIGS. 9-12 illustrate an alternative embodiment of the present coupler system having another alternative spring lock.

Figure 1:
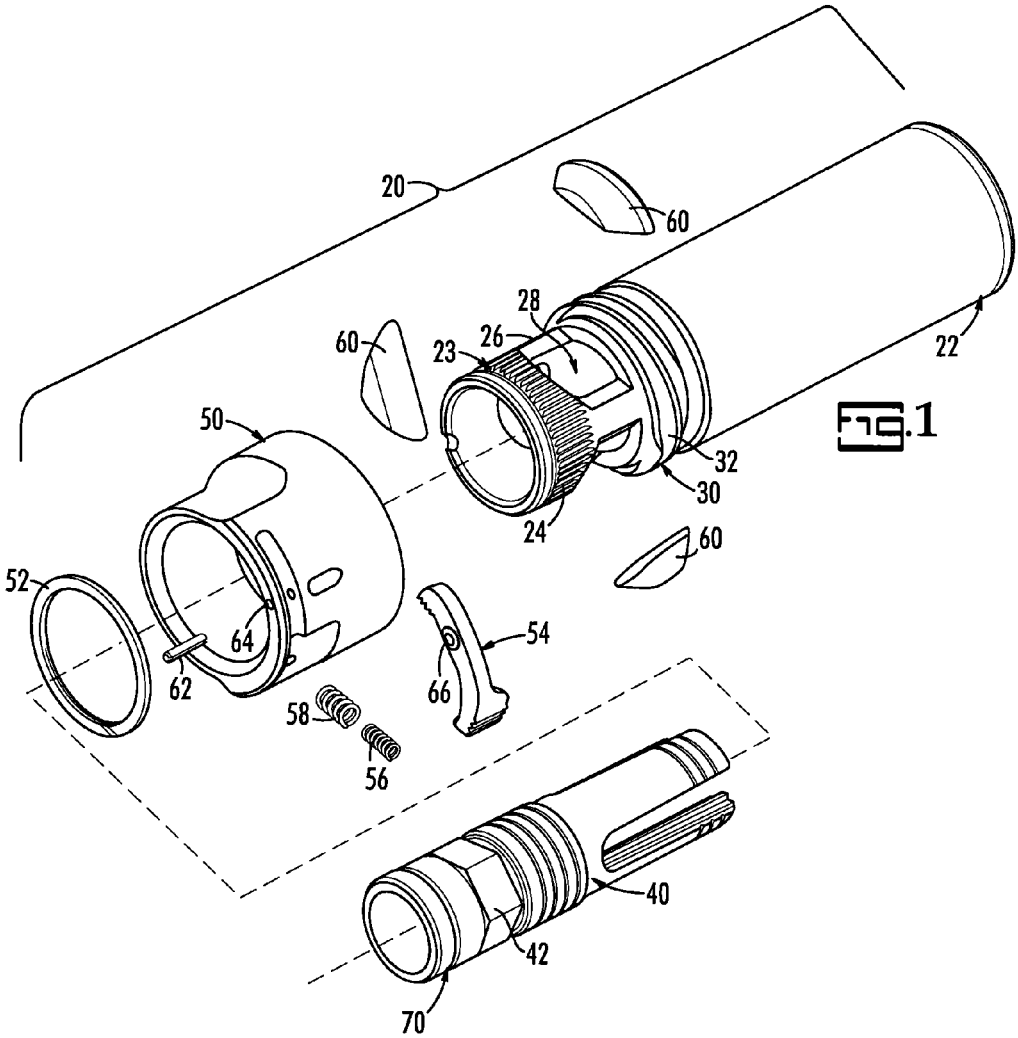
FIG. 1 is an exploded view of a coupler system for attaching a sound suppressor to a flash hider of a firearm, according to an embodiment of the present invention.
Figure 2:
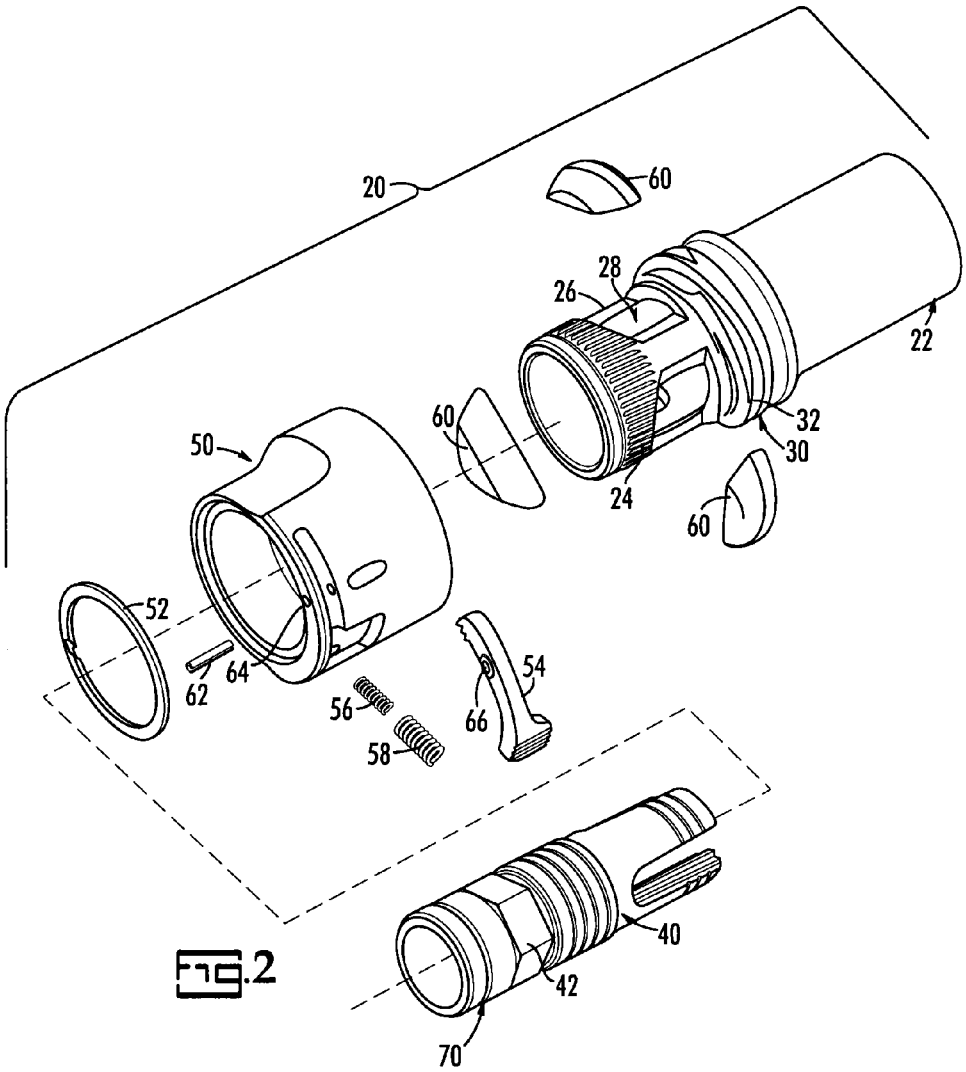
FIG. 2 is an exploded view of a coupler system for attaching a blank adaptor to the flash hider of a firearm, according to an embodiment of the present invention.

Referring now to FIGS. 1 and 2, there are shown two exploded perspective views of the present coupler system, generally indicated by reference number 20. In FIG. 1, coupler system 20 includes an attachable device 22 that is a sound suppressor. In FIG. 2, coupler system 20 includes attachable device 22 that is a blank adaptor. In both FIGS. 1 and 2, the proximal end of attachable device 22 is modified in the same way, namely, a gear surface 24 is formed at its most proximal end (proximal determined from the point of view of the one firing the firearm) followed by a annular region 26 with cutouts 28 formed there through. Annular region 26 is in turn followed in the distal direction by a threaded region 30 with threads 32. Blank adaptor also has a stem 34 and the suppressor has a shoulder 36 both of which are distal to threads 32 and used to index the coupler. The balance of the suppressor (FIG. 1) and the blank adaptor (FIG. 2) have such internal features as suppressors and adaptors normally have; only the proximal ends are modified as just described.

Coupler system 20 is made to be used with a firearm with a barrel on which is fastened a flash hider such as flash hider 40 in FIGS. 1 and 2, which may also be a prior art flash hider modified for use with coupler system 20. In the embodiment shown, flash hider 40 is made or modified to have flat surfaces 42 or other latch-engaging surface configuration.

U.S. provisional patent application Ser. No. 61/375,339 and Ser. No. 61/375,570, both filed Aug. 20, 2010 are related applications for examples of attachable devices 22 and a flash hider 40 and are incorporated in their entirety by reference.

Coupler system 20 includes a collar 50, a stop ring 52, a spring lock 54 with springs 56 and 58 and camming latches 60. Camming latches 60 have a bottom surface that may conform to the latch-engaging portion of flash hider 40. If that portion is flat; the bottom side of camming latches 60 is flat as shown; if it is curved; the bottom side of camming latches is curved with the same radius of curvature. Spring lock 54 pivots about a pivot pin 62 which is inserted into a hole 64 through collar 50 and through a hole 66 through spring lock 54 to enable spring lock 54 to pivot freely against the urging of springs 56, 58. Camming latches 60 fit into cutouts 28 in annular region 26 of attachable device 20 where they can engage flat surfaces 42 of flash hider 40. There they are held against axial movement but are able to move radially. Finally, stop ring 52 is a spring lock that snaps into an annular groove 70 on flash hider and there acts as a stop to prevent removal of collar 50 in the proximal direction when unlocking collar 50.

Figure 3:
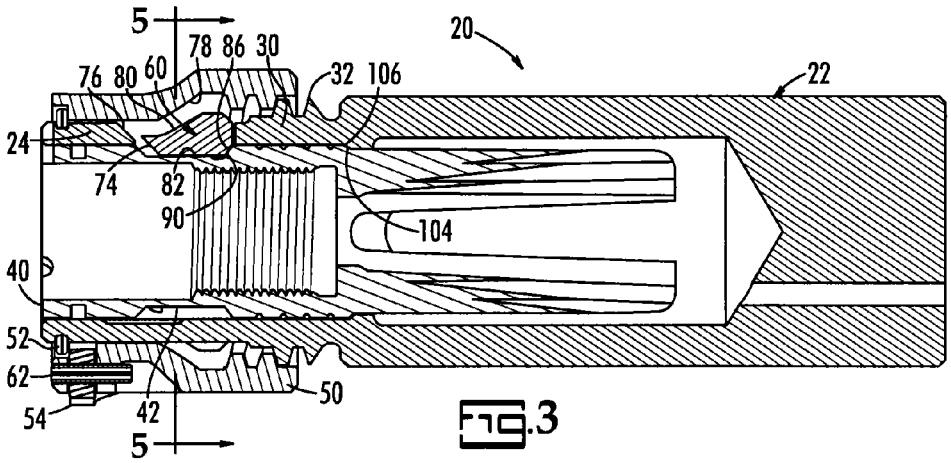
FIG. 3 is a cross-sectional side view of a coupler system in the unlocked position, according to an embodiment of the present invention.
Figure 4:
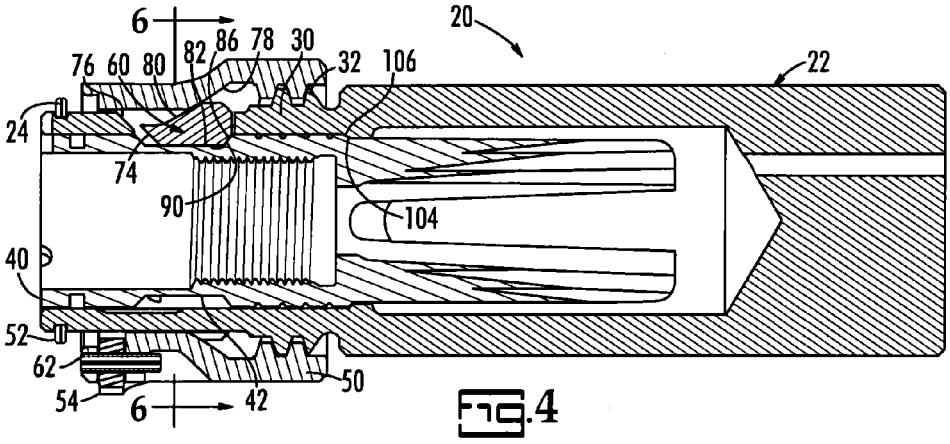
FIG. 4 is a cross-sectional side view of the coupler system of FIG. 3 shown in the locked position, according to an embodiment of the present invention.

Referring now to FIGS. 3 and 4, there are shown cross-sectional views of coupler system 20 in the unlocked and locked positions, respectively. Attachable device 22 in these figures is blank adapter but may be a different type of attachable device 22. In FIG. 3, collar 50 is shown moved in the proximal direction where its rearward motion is stopped by stop ring 52. In this position, flash hider 40 may be withdrawn from device 20 or attachable device 22 may be rotated about its axis. When flash hider 40 is withdrawn, a distal wall 86 on its interior surface that marks the distal boundary of flat surface 42, and which wall 86 is inclined, will cam against the corresponding angled distal wall 74 of camming latch 60 thereby urging camming latch 60 to move radially outward against collar 50. Because collar 50 is in the unlocked, proximal position, there is sufficient space between it and camming latch 60 for camming latch 60 to move radially outward by enough distance to allow flash hider 40 to clear camming latch 60 from below. However, when collar 50 is in the locked position (FIG. 4), radial movement of camming latch 60 is prevented by the engagement of collar 50 against the upper surface 80 of camming latch 60. Collar 50 has an interior surface 78 formed to engage upper surface 80 of camming latch 60 and apply pressure to it when the lower surface 82 of camming latch 60 is already pressing against hider 40 and the forward surface 86 of camming latch 60 is engaging the side surface 90 of flash hider 40. Having no other direction left to which it can move when collar 50 is in the locked position, camming latch 60 thus prevents proximal movement of flash hider 40.

Flash hider 40 has an annular stepped-down portion, or, more precisely, ramped-down portion 104, as it is angled at less than 90° with respect to the long dimension of flash hider 40 where the diameter of flash hider 40 narrows slightly. Device 22 has a corresponding rampeddown portion 106 where its wall thickness gradually increases. Ramped-down portions 104 and 106 are located so that they seal against each other when device 22 is mounted to flash hider 40 and threaded thereto by rotating collar 50. As spherical camming latches 60 enter cutouts 28, they exert pressure on the seal between ramped-down portions 104, 106, making them gas tight while, at the same time, preventing collar 50 from backing off device 22.

FIGS. 5, 6, and 7 illustrate the operation of spring lock 54. Spring lock 54 prevents rotation of collar 50, either when in the unlocked position (FIG. 3) or in the locked position (FIG. 4). Spring lock 54 operates like a pawl on gear surface 24, pivoting about its pivot pin 62. When its first end 96 is pressed against the urging of compression springs 56, 58 to pivot its opposing second end 98 out of engagement between the teeth 100 of gear surface 24 (as best seen in FIG. 7), collar 50 is freed and can be rotated between its locked and unlocked positions with respect to attachable device 22. Releasing first end 96 of spring lock 54 causes second end 98 of spring lock 54 to again engage teeth 100 of gear surface 24.

Referring now to FIG. 8, there is illustrated an exploded view of a coupler system 20' that is in almost every respect the same as that illustrated in FIGS. 1 and 2, save for the spring lock 54'. Spring lock 54' pivots about a pivot pin 62' that is oriented 90 degrees from that of pivot pin 62. Accordingly the orientation of spring lock 54' is rotated 90 degrees from that of spring lock 54. However, its operation is essentially the same: by pressing on a first end 96' against the urging of spring 56', the opposing second end 98' of spring lock 54' lifts free of gear surface 24 and allows collar 50 to be rotated and advanced or retreated with respect to attachable device 22.

Referring now to FIGS. 9-12, FIG. 9 illustrates the components of the present coupler system, generally indicated by reference number 110, in an exploded view. In this view, a flash hider 112 is shown with a proximal end 114 and opposing distal end 116. Proximal end 114 is formed with interior threads in order to allow hider 112 to be threaded to the barrel of a firearm (not shown). Distal end 116 is also formed with three gaps 118 around its annular opening. Between proximal end 114 and distal end 116 is a region 120 with a hexagonal cross-section so as to permit a wrench to be used to fasten flash hider 112 to the barrel.

Proximate to region 120 are six partial, spherical cutouts 124 serving as the latch-engaging surface of this embodiment rather than the flat surfaces 42 described above. The purpose of these six partial, spherical cutouts 124 will be explained below.

Figure 9:
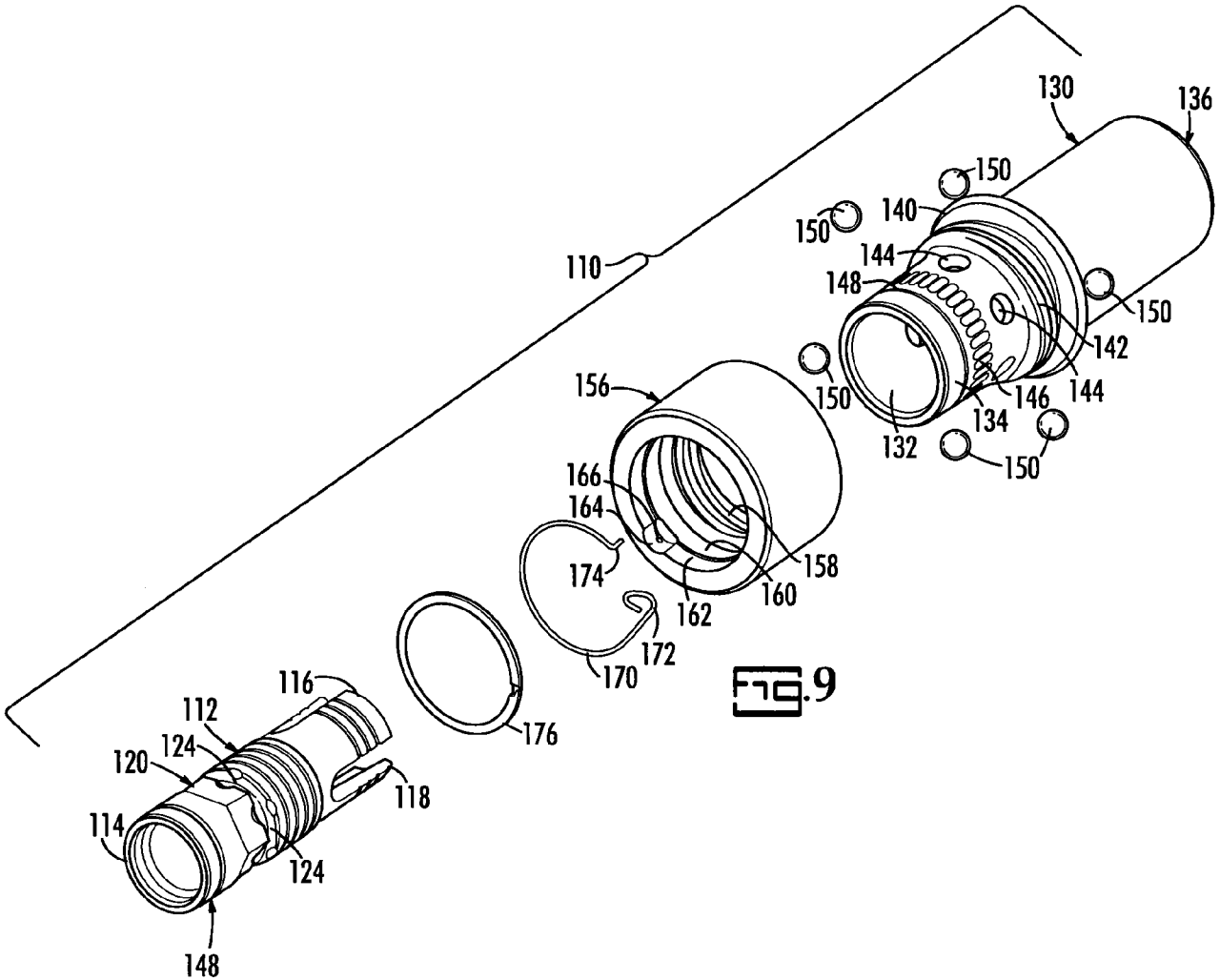
FIG. 9 is an exploded perspective view of yet another alternative embodiment of the present invention having a different spring lock and spherical camming latches.
Figure 10:
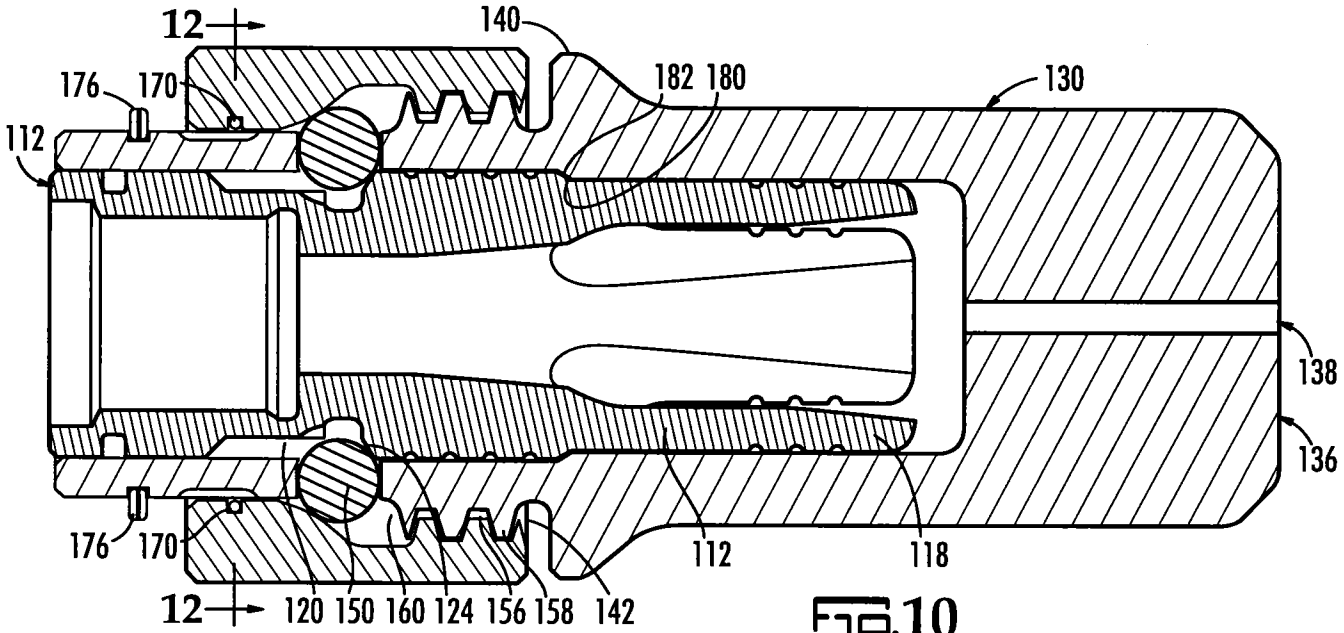
FIG. 10 is a side cross-sectional view of a coupler system shown in the locked position, according to the embodiment of FIG. 9.
Figure 11:
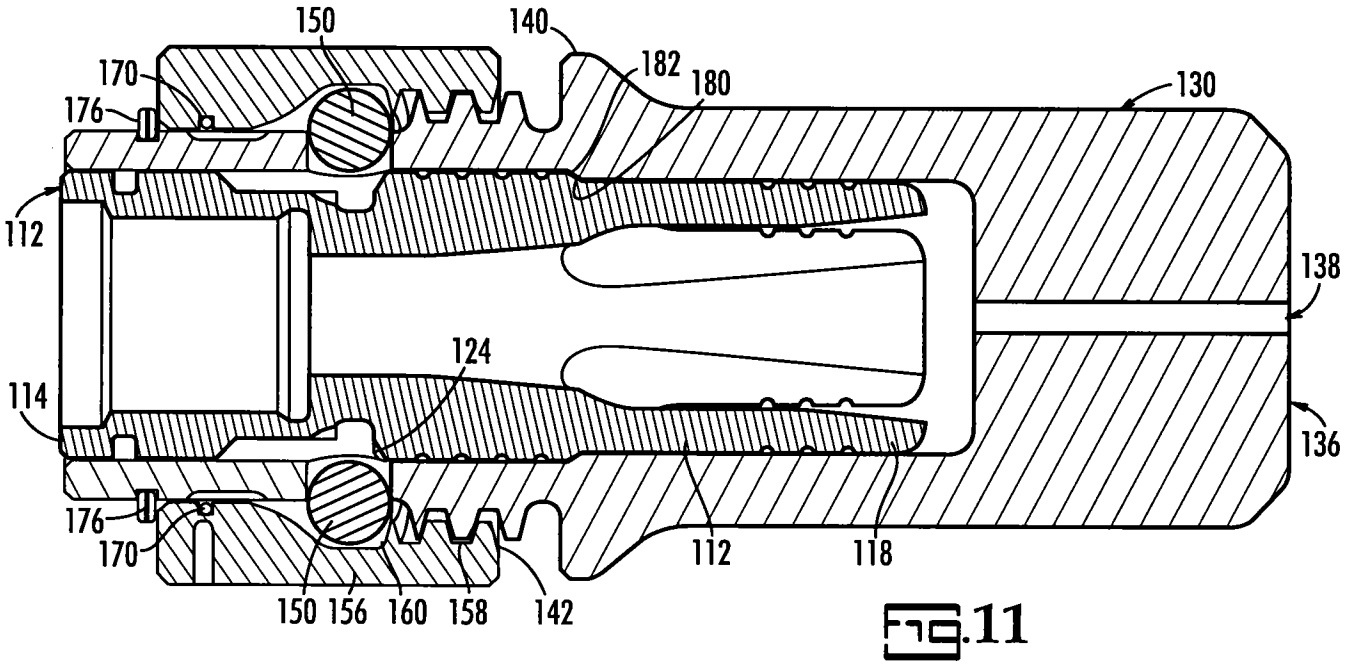
FIG. 11 is a side cross-sectional view of a coupler system shown in the unlocked position, according to the embodiment of FIG. 9.
Figure 12:
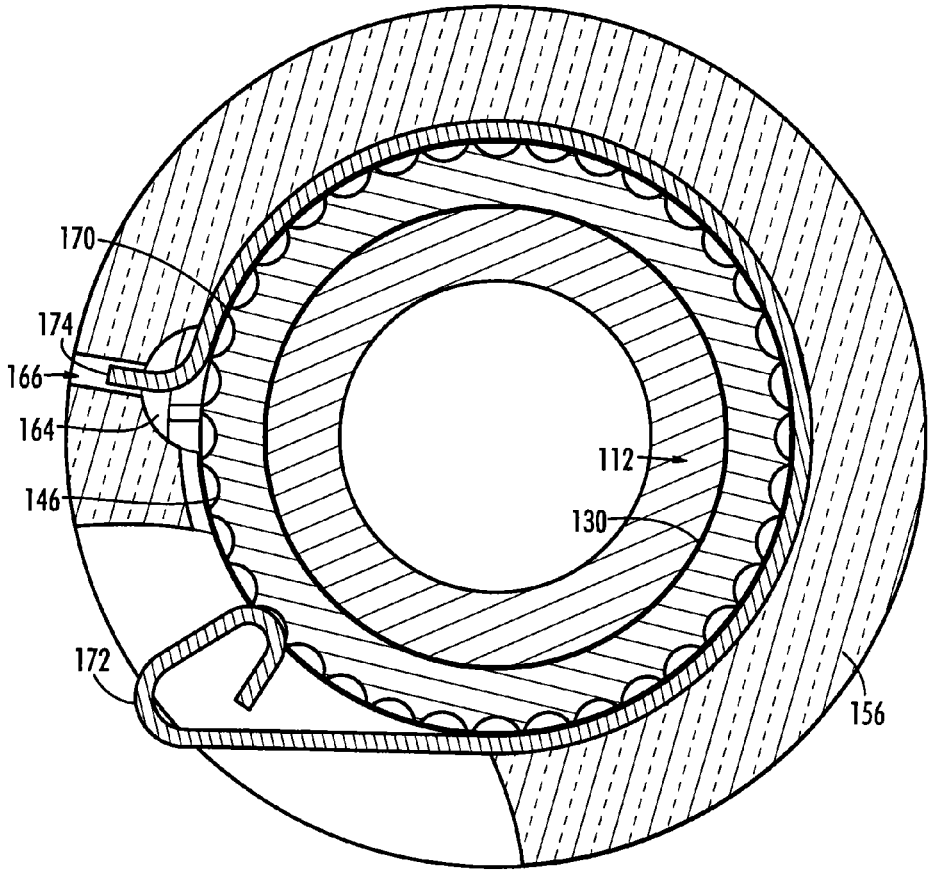
FIG. 12 is a cross-sectional view of the coupler system showing the spring lock taken along lines 12-12 of FIG. 9.

FIG. 9 also shows an attachable device 130 having an opening 132 at a proximal end 134 and, at the opposing distal end 136, a small opening 138 (see FIGS. 10 and 11). Device 130 is similar to prior art blank adaptors and sound suppressors and its structure for performing in either of those capacities is conventional. However, device 130 is modified for the present coupler system 110.

In particular, device 130 has an annular flange 140, exterior threads 142 proximal to annular flange 140, a series of six circular holes 144 formed in its peripheral surface proximal to exterior threads 142, a band of scalloped recesses 146 near its proximal end 134, and an annular spring groove 148 at its proximal end 134. The function of these features will be explained below as well.

A set of six spherical camming latches or other number sufficient to adequately retain the device 130 are used to lock coupling system 110 in the following manner. These six spherical camming latches 150 are inserted in the six holes 144 formed about the surface of device 130. A number of spherical camming latches other than six may be used if the number of holes 144 is correspondingly adjusted to be at least equal to the number of spherical camming latches 150. Preferably, the total number of holes 144 and spherical camming latches 150 is greater than two, producing a self-centering effect.

System 110 includes a collar 156 having interior threads 158 that mate with exterior threads 142 of device 130. Collar 156 also has a tapered annular groove 160 and a stepped portion 162 having a recess 164 with a hole 166 formed in collar 156 along with interior threads 158.

Finally, system 110 also includes a wire spring 170 with a loop 172 at one end and a catch 174 at the other end.

Wire spring 170 is inserted into the interior of collar 156 against stepped portion 162 with catch 174 inserted in hole 166 of recess 164. Loop 172 of wire spring 170 is inserted in the closest scalloped recess 164 on the surface of device 130 (see FIG. 12) as collar 156 is slid over proximal end 134 of device 130, thereby mating interior threads 158 of collar 156 with exterior threads 142 of device 130. Stop ring 176 is fitted to annular groove 148 after collar 156 is in place to secure collar 156 to device 130. See FIGS. 10 and 11. Holes 144 of device 130 are alignable with partial, spherical cutouts 124 on flash hider 112 by rotating device 130 with respect to flash hider 112. Spherical camming latches 150 are held in tapered annular groove 160 and holes 144 as collar 156 is rotated. Once spherical camming latches 150 are seated in partial spherical cutouts 124, collar 156 can not be advanced and wire spring 170 holds collar 156 in place with respect to device 130.

Flash hider 112 has an annular stepped down portion, or, more precisely, ramped-down portion 180 as it is angled at less than 90° with respect to the long dimension of flash hider 112 where the diameter of flash hider 112 narrows slightly. Device 130 has a corresponding ramped-down portion 182 where its wall thickness increases. Ramped-down portions 180 and 182 are located so that they seal against each other when device 130 is mounted to flash hider 112 and threaded thereto by rotating collar 156. As spherical camming latches 160 enter spherical cutouts 124, they exert pressure on the seal between ramped-down portions 180, 182, making them gas tight while, at the same time, preventing collar 156 from backing off device 130.

As collar 156 is threaded to device 130, tapered annular groove 160 cams spherical camming latches 150 radially inward, into partial, spherical cutouts 124 where they lock device 130 to flash hider 112. Also, as collar 156 is rotated, looped end 172 of wire spring 170 is urged from one scalloped cutout 146 to the next in the band of scalloped cutouts 146 (see FIGS. 9 and 12) by the force applied by the user in rotating collar 156 clockwise. That force also works to prevent collar 156 from inadvertently backing off device 130, even when the firearm is in use.

Coupling system 110 operates to securely lock device 130 to flash hider 112 and to keep it locked during use. In addition to this primary function, it will be noted that the holes 144 of device 130 may be positioned in one of six possible ways (given the presently illustrated embodiment of six holes 144 and six spherical camming latches 150) with respect to the partial spherical cutouts 124. If the firearm has been properly zeroed, that is, its sights have been adjusted for the particular marksman and for the ammunition being used, but without device 130 mounted to the barrel of the firearm (and if device 130 is a sound suppressor rather than a blank adaptor), then the addition of device 130 will inevitably have an effect on the marksman's accuracy however small that effect may be. That effect will vary very slightly from one to another among these six positions. One of them, however, will affect the marksman's accuracy less than the others. The marksman can mark the hole 144 in device 130 corresponding to the position having the least effect on accuracy so that he or she can align device 130 and flash hider 112 the same way each time device 130 is threaded to hider 112.

Those familiar with firearms and their attachments will appreciate that many modifications and substitutions can be made to the foregoing preferred embodiments of the present invention without departing from the spirit and scope of the present invention, defined by the appended claim.

What is claimed is:

1. A coupling system for attaching a device such as a sound suppressor or blank adaptor to a flash hider of a firearm, comprising:

a flash hider of a firearm with an annular groove and an exterior surface formed to have a latch-engaging portion of said exterior surface of said flash hider;

an attachable device formed to receive said flash hider therein and having external threads and with plural cutouts formed there through, said cutouts being alignable with said latch-engaging portion of said exterior surface when said flash hider is received into said attachable device;

plural camming latches in said plural cutouts, each camming latch of said plural camming latches being in a cutout of said plural cutouts, said camming latches engaging said latch-engaging portion of said exterior surface of said flash hider when said flash hider is received into said attachable device and said latch-engaging portion is aligned with said plural cutouts;

a collar having interior threads and an interior surface, said collar being threadable to said attachable device over said plural camming latches, said collar having a locked position wherein said collar engages said camming latches to prevent movement of said camming latches, and an unlocked position wherein said collar allows said camming latches to be moved radially outward from said cutouts; and a spring lock for holding said collar in said locked position.

2. The coupling system as recited in claim 1 wherein said attachable device has a gear surface with teeth and wherein said spring lock has a first end and an opposing second end, said second end being between said teeth of said gear surface to prevent rotation of said gear surface with respect to said collar.

3. The coupling system as recited in claim 1, further comprising a stop ring carried in said annular groove of said flash hider, said stop ring limiting proximal travel of said collar when said collar is rotated counter-clockwise with respect to said attachable device.

4. The coupling system as recited in claim 1, wherein said latch engaging portion further comprises plural flat surfaces on said flash hider.

5. The coupling system as recited in claim 1, wherein said camming latches are spherical and said cutouts are circular holes.

6. A coupling system for attaching a device such as a sound suppressor or blank adaptor to a flash hider of a firearm, comprising:

a flash hider of a firearm with an annular groove and an exterior surface formed to have plural flat portions of said exterior surface of said flash hider;

an attachable device formed to receive said flash hider therein and having external threads and with plural cutouts formed there through, said cutouts being alignable with said plural flat portions of said exterior surface when said flash hider is received into said attachable device;

plural camming latches in said plural cutouts, each camming latch of said plural camming latches being in a cutout of said plural cutouts, said each camming latch having a flat side, said flat side of said each camming latch being engagable with a flat portion of said plural flat portions of said exterior surface of said flash hider when said flash hider is received into said attachable device;

a collar having interior threads and an interior surface, said collar being threadable to said attachable device, said plural camming latches being in said cutouts and said flash hider being received in said attachable device so that said plural flat portions are in registration with said cutouts, said collar having a locked position with respect to said attachable device wherein said collar engages said camming latches to prevent their movement and an unlocked position wherein said collar allows said camming latches to be moved radially outward from said cutouts; and a spring lock for holding said collar in said locked position.

7. The coupler system as recited in claim 6, wherein said plural camming latches have upper surfaces and wherein said interior surface of said collar cams said upper surfaces of said camming latches force said flat surfaces of said plural latches against said flat portions of said flash hider when said flash hider is received in said attachable device and said collar is moved to said locked position.

8. A coupling system for attaching a device such as a sound suppressor or blank adaptor to a flash hider of a firearm, comprising:

a flash hider of a firearm with an annular groove and an exterior surface formed to have plural flat portions of said exterior surface of said flash hider;

an attachable device formed to receive said flash hider therein and having external threads and with plural cutouts formed there through, said cutouts being alignable with said plural flat portions of said exterior surface when said flash hider is received into said attachable device;

plural camming latches in said plural cutouts, each camming latch of said plural camming latches being in a cutout of said plural cutouts, said each camming latch having a flat side, said flat side of said each camming latch being engagable with a flat portion of said plural flat portions of said exterior surface of said flash hider when said flash hider is received into said attachable device; and a collar having interior threads and an interior surface, said collar being threadable to said attachable device, said plural camming latches being in said cutouts and said flash hider being received in said attachable device so that said plural flat portions are in registration with said cutouts, said collar having a locked position with respect to said attachable device wherein said collar engages said camming latches to prevent their movement and an unlocked position wherein said collar allows said camming latches to be moved radially outward from said cutouts.

9. The coupler system as recited in claim 8, wherein said attachable device is a sound suppressor.

10. The coupler system as recited in claim 8, wherein said attachable device is a blank adaptor.

11. A coupling system for attaching a device such as a sound suppressor or blank adaptor to a flash hider of a firearm, comprising:

a flash hider of a firearm with an annular groove and an exterior surface formed to have plural latch engaging surfaces carried thereon;

an attachable device formed to receive said flash hider therein and having an exterior surface carrying external threads and with plural cutouts formed there through, said cutouts being alignable with said plural flat portions of said exterior surface when said flash hider is received into said attachable device, said attachable device having a gear surface on said external surface;

plural camming latches in said plural cutouts, each camming latch of said plural camming latches being in a cutout of said plural cutouts, said each camming latch being engagable with a latch engaging surface of said plural latch engaging surface of said exterior surface of said flash hider when said flash hider is received into said attachable device;

a collar having interior threads and an interior surface, said collar being threadable to said attachable device, said plural camming latches being in said cutouts and said flash hider being received in said attachable device so that said plural camming latches are in registration with said cutouts, said collar having a locked position with respect to said attachable device wherein said collar engages said camming latches to prevent their movement and an unlocked position wherein said collar allows said camming latches to be moved radially outward from said cutouts; and a spring latch for holding said collar in said locked position, said spring latch including a pivot pin and a spring, said pivot pin pivotally attaching said spring latch to said collar and said spring urging said spring latch to engage said gear surface of said attachable device.

* * * * *